US008887787B2

(12) United States Patent
Jang

(10) Patent No.: US 8,887,787 B2
(45) Date of Patent: Nov. 18, 2014

(54) DUAL ROLL BLIND

(75) Inventor: Seong-Ryong Jang, Seoul (KR)

(73) Assignee: Wintec Korea Inc., Gwangju-si, Gyeonggi-do (KR)

( * ) Notice: Subject to any disclaimer, the term of this patent is extended or adjusted under 35 U.S.C. 154(b) by 0 days.

(21) Appl. No.: 13/807,296

(22) PCT Filed: Jun. 24, 2011

(86) PCT No.: PCT/KR2011/004626

§ 371 (c)(1), (2), (4) Date: Dec. 27, 2012

(87) PCT Pub. No.: WO2012/002679

PCT Pub. Date: Jan. 5, 2012

(65) Prior Publication Data

US 2013/0240156 A1 Sep. 19, 2013

(30) Foreign Application Priority Data

Jun. 28, 2010 (KR) ..... 10-2010-0061049

(51) Int. Cl.

| | |
|---|---|
| ***E06B 9/08*** | (2006.01) |
| ***E06B 9/42*** | (2006.01) |
| *E06B 9/40* | (2006.01) |
| *E06B 9/24* | (2006.01) |

(52) U.S. Cl.

CPC ..... *E06B 9/40* (2013.01); *E06B 2009/405* (2013.01); *E06B 2009/2458* (2013.01); *E06B 9/42* (2013.01); *E06B 2009/2405* (2013.01)

USPC ..... 160/120; 160/241

(58) Field of Classification Search

USPC ..... 160/85, 86, 89, 113, 114, 115, 120, 160/241; 74/405, 342

See application file for complete search history.

(56) References Cited

U.S. PATENT DOCUMENTS

| | | | | |
|---|---|---|---|---|
| 2,280,358 | A * | 4/1942 | Tietig | 160/120 |
| 2,581,433 | A * | 1/1952 | North et al. | 160/120 |
| 4,418,739 | A * | 12/1983 | Woolnough et al. | 160/120 |

(Continued)

FOREIGN PATENT DOCUMENTS

| | | | |
|---|---|---|---|
| JP | 2009-138326 | A | 6/2009 |
| KR | 20-0398864 | Y1 | 10/2005 |

(Continued)

*Primary Examiner* — Katherine Mitchell
*Assistant Examiner* — Johnnie A Shablack
(74) *Attorney, Agent, or Firm* — Novick, Kim & Lee, PLLC; Jae Youn Kim

(57) ABSTRACT

A dual roll blind is provide. The dual roll blind may include a first screen and a second screen having light transmission portions and light shielding portions, respectively, a first winding bar and a second winding bar for respectively winding the first screen and the second screen, a first gear for rotationally driving the first winding bar, a second gear for rotating the second winding bar with rotating dependently on the first gear, an engagement maintaining portions for providing elasticity in the same direction as the mounting direction of the axis of rotation to one of the first gear or the second gear to prevent the gear from breaking away, and a clutch body holding inside the first gear, the second gear, and the engagement maintaining portions. The clutch body can include a setting hole corresponding to the engagement maintaining portions, and at least one of the first gear, and the second gear is interposed between the setting hole and the engagement maintaining portions.

8 Claims, 6 Drawing Sheets

(56) References Cited

U.S. PATENT DOCUMENTS

| | | | | |
|---|---|---|---|---|
| 4,466,475 | A | 8/1984 | Saito et al. | |
| 5,538,065 | A | 7/1996 | Geraud | |
| 6,189,592 | B1 * | 2/2001 | Domel | 160/85 |
| 7,174,940 | B2 * | 2/2007 | Nien | 160/120 |
| 7,207,371 | B2 * | 4/2007 | Hsu | 160/85 |
| 7,665,502 | B2 | 2/2010 | Dekker | |
| 7,849,907 | B2 * | 12/2010 | Jang | 160/86 |
| 8,025,088 | B2 * | 9/2011 | Kim | 160/120 |
| 2006/0027339 | A1 * | 2/2006 | Hsu | 160/120 |
| 2007/0084568 | A1 * | 4/2007 | Nien | 160/85 |
| 2008/0190569 | A1 | 8/2008 | Jang | |
| 2009/0173454 | A1 * | 7/2009 | Cheng | 160/120 |
| 2011/0061821 | A1 * | 3/2011 | Kim | 160/305 |
| 2012/0291965 | A1 * | 11/2012 | Marocco | 160/120 |
| 2013/0098563 | A1 | 4/2013 | Jang | |

FOREIGN PATENT DOCUMENTS

| | | | |
|---|---|---|---|
| KR | 20-0444675 | Y1 | 5/2009 |
| WO | 2007004852 | A1 | 1/2007 |
| WO | 2008004805 | A1 | 1/2008 |
| WO | 2009136683 | A1 | 11/2009 |

* cited by examiner

DUAL ROLL BLIND

TECHNICAL FIELD

The present invention relates to a dual roll blind, and more particularly, to a dual roll blind enabling to control its light transmission amount and open and close with one ball-chain and to easily reset the roll screen.

BACKGROUND ART

Generally, a roll blind is a device mounted on a transparent glass window or glass wall for blocking light from the outside to control interior atmosphere or for covering the inside not to be seen from outside.

The conventional roll blind has a structure that one roll screen having the same light transmittance in whole area is wound around a bar for winding to block the light. Such a roll blind has a structure that a roll screen is wound up around a bar for winding fixed on upper portion and controlling the height of the roll screen is only a way to control the light transmission amount.

According to the way controlling the light transmission amount by controlling the height of roll screen, the light completely penetrates a part (the lower portion) of the glass window or glass wall and is completely blocked in a part (the upper portion), so it is impossible to uniformly control the light transmission amount in the whole area of glass window or glass wall. Therefore, required is a structure capable to uniformly control the light transmission amount in whole area.

To solve such a problem, a method for controlling the light transmission amount by-disposing two sheets of roll screens comprising light transmitting portions and light shielding portions alternately disposed widthwise or lengthwise to be overlapped and controlling the overlapped amount was proposed in the past.

However, most of such devices place emphasis on the function for controlling the light transmission amount and such devices become complicated and shoddy. That is, since such devices have a function controlling the light transmission amount, however, those are too big or complicated, some problems that the practicality and durability deteriorate are encountered.

Especially, since an operating apparatus for controlling the overlapped amount of two roll screens is needed separately from a ball-chain for operating a winding bar to control the light transmission amount, the operation of roll blind becomes complicated and the device become complicated. Accordingly, the cost increases and the durability and the credibility of the device deteriorate and such products are avoided in the market.

Accordingly, a roll blind having a structure enabling ascent and descent of roll screen and control of the overlapped amount of two sheets of roll screens with one ball-chain, a simple mechanical structure, and a good credibility in spite of repeated operations is required.

In addition, since there is a problem that the light shielding portions and the light transmitting portions of two sheets of roll screens are out of match in initial fabrication or by the deformation due to a long-time use, a structure that the light shielding portions and the light transmission portions of the roll screens can easily be reset is required.

DISCLOSURE OF INVENTION

Technical Problem

A technical object to achieve of the present invention is to provide a dual roll blind enabling to control the light transmission amount of the roll screen and its open and close with one single ball-chain and to easily initial-set the roll screen.

Technical objects of the present invention are not limited to above-mentioned ones and unmentioned other technical objects can clearly be understood by a person of ordinary skill in the pertinent art through the following description.

Solution to Problem

A dual roll blind according to an embodiment of the present invention to achieve the above technical object comprises a first screen and a second screen having light transmission portions and light shielding portions, respectively, a first winding bar and a second winding bar for respectively winding the first screen and the second screen, a first gear for rotationally driving the first winding bar, a second gear for rotating the second winding bar with rotating dependently on the first gear, an engagement maintaining portions for providing elasticity in the same direction as the mounting direction of the axis of rotation to one of the first gear or the second gear to prevent the gear from breaking away, and a clutch body holding inside the first gear, the second gear, and the engagement maintaining portions, wherein the clutch body comprises a setting hole corresponding to the engagement maintaining portions, and at least one of the first gear and the second gear is interposed between the setting hole and the engagement maintaining portions.

Advantageous Effects of Invention

According to the present invention, the open and close and the light transmission amount of roll screen can simultaneously be controlled by operating one single ball-chain. Especially, since the open and close structure and the light transmission amount controlling structure of roll screen are made in one simple and credible mechanic structure, the cost-reduction effect is excellent because of the simplification of the structure and the device has an excellent durability in spite of repeated operations.

In addition, since two sheets of roll screens overlapped each other are generally used for a dual roll blind, the arrangement of the light shielding portions and the light transmitting portions printed on the roll screens is indispensable, however, two winding bars around which the roll screens are wound are fixed to gears engaging with each other, so it is not easy to separately rotate each winding bar.

On the contrary, according to the present invention, the heights of the roll screens wound respectively around the winding bars can easily be controlled by disengaging the gears coupled to two winding bars in a simple way.

DESCRIPTION FOR KEY ELEMENTS IN THE DRAWINGS

Figure 1:
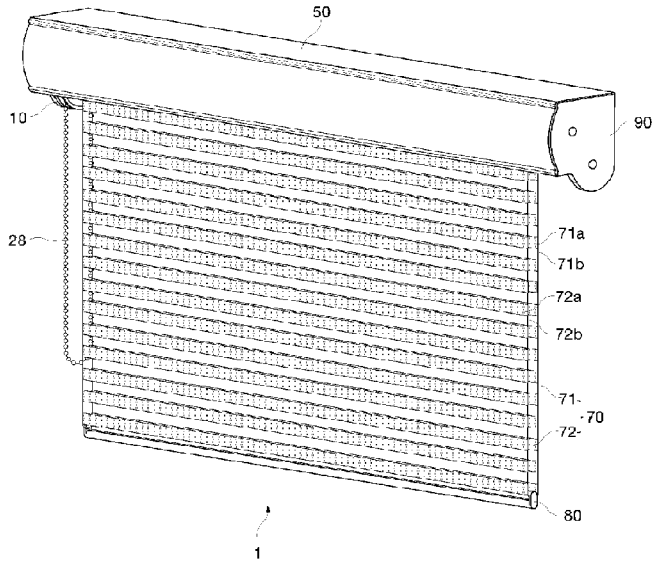
FIG. 1 is a perspective view of a dual roll blind according to an embodiment of the present invention.

1: dual roll blind
2: clutch module
10: clutch body
11: first axis of rotation
12: second axis of rotation
20: first gear
25: chain gear
30: second gear
35: clutch hub
40: clutch cover
50: support frame
51: gear supporting member
52: elastic member
61: first winding bar
62: second winding bar
70: roll screen
71: first screen
71*a*, 72*a*: light shielding portions
71*b*, 72*b*: light transmitting portions
72: second screen
80: weight member
90: end body

MODE FOR THE INVENTION

Advantages and features of the present invention and methods to achieve the same will be clear by referring to the attached drawings and the following embodiments described in detail. However, the present invention is not limited to the following described embodiments but can be realized in various forms different from each other. The present embodiments are provided only to make the description of the present invention perfect and to let persons of ordinary skill in the pertinent art perfectly know the scope of the invention and the present invention is defined only by the scope of claims. Like reference numerals denote like parts throughout the specification and drawings.

Hereinafter, a dual roll blind according to an embodiment of the present invention will be described in detail referring to FIGS. 1 to 5.

Figure 2:
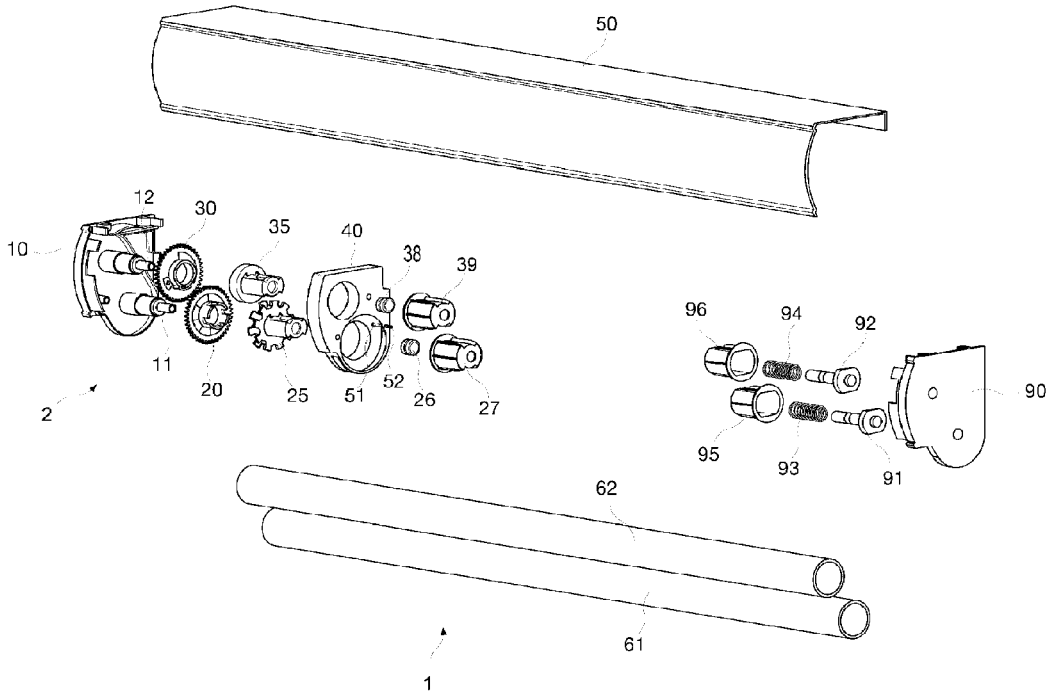
FIG. 2 is an exploded perspective view of the dual roll blind in FIG. 1.

FIG. 1 is a perspective view of a dual roll blind according to an embodiment of the present invention and FIG. 2 is an exploded perspective view of the dual roll blind in FIG. 1.

The dual roll blind 1 according to an embodiment of the present invention is a device capable to control the light transmission amount as well as the open and close of roll screen 70 only by operating one single ball chain 28.

The dual roll blind 1 comprises two roll screens 70 having light shielding portions 71*a* and 72*a* and light transmitting portions 71*b* and 72*b*, two winding bars 61 and 62 for respectively winding the two roll screens 70, and a ball chain 28 for rotating the two winding bars 61 and 62.

To describe the above concretely referring to FIGS. 1 and 2, the first winding bar 61 and the second winding bar 62 around which the first screen 71 and the second screen 72 are respectively wound are held inside a structure comprising a support frame 50, a clutch body 10, and an end body 90.

The support frame 50 is a part forming a support structure of the dual roll blind 1 with the clutch body 10 and the end body 90 and holds the first winding bar 61 and the second winding bar 62 inside. The support frame 50 like the above does a function for fixing the dual roll blind 1 to a ceiling or a window frame, etc.

The support frame 50 connects the clutch body 10 and the end body 90 and its length can be changed in response to the lengths of the first winding bar 61 and the second winding bar 62 held inside. The support frame 50 can be formed in the upper portion or in the front and back sides of the first winding bar 61 and the second winding bar 62. For example, as shown in FIG. 2, the support frame 50 can be formed to have a cross-section of the connected upper and front portions in the form of 'ㄱ'. That is, the support frame 50 shown in FIG. 2 does a role of a support structure, besides does a role of protecting the first winding bar 61 and the second winding bar 62 held inside and preventing dust from entering inside.

On both ends of the support frame 50, the clutch body 10 and the end body 90 are coupled. In addition, the first winding bar 61 around which the first screen 71 is wound and the second winding bar 62 around which the second screen 72 is wound are rotatably coupled between the clutch body 10 and the end body 90.

The clutch body 10 forms a clutch module 2 by being coupled with a clutch cover 40 and comprising a first gear 20 and a second gear 30 inside. The clutch module 2 like the above does a function to selectively transmit rotational force to the first winding bar 61 and the second winding bar 62 or to control the light transmission amount of the dual roll blind 1.

The clutch body 10 and the clutch cover 40 hold inside the first gear 20, the second gear 30, a chain gear 25, a clutch hub 35, springs 26 and 38, plugs 27 and 39, and an engagement maintaining portion 51 and 52.

The clutch body 10 comprises a first axis of rotation 11 and a second axis of rotation 12 to which the first gear 20 and the second gear 30 are respectively coupled. The first gear 20 which is a driving gear is coupled to which the first axis of rotation 11 and the second gear 30 which is a driven gear is coupled to the second axis of rotation 12. Accordingly, the first gear 20 and the second gear 30 engage with each other and the second gear 30 rotates depending on the first gear 20.

Figure 3:
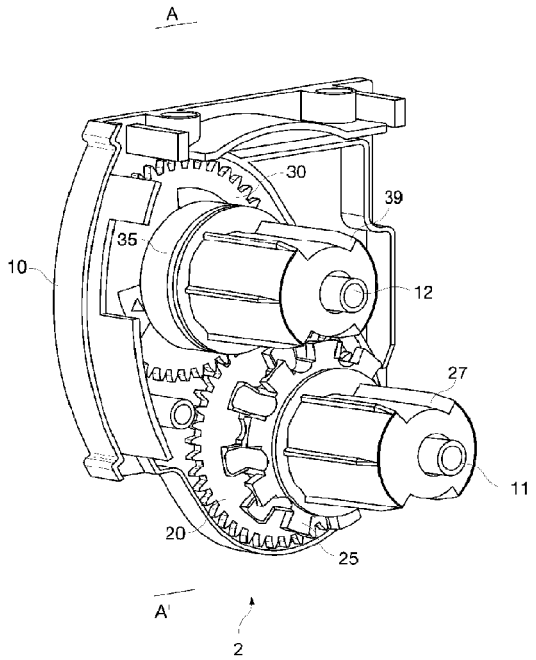
FIG. 3 is a partial exploded perspective view of a clutch module included in the dual blind in FIG. 1.

Only, as shown in FIGS. 2 and 3, it is not limited to the engagement of the first gear 20 and the second gear 30 with each other, but one or more intermediate gear (not shown) can be included between the first gear 20 and the second gear 30 if necessary.

The chain gear 25 driven by a ball-chain 28 is coupled to the first gear 20 and the first gear 20 unwinds/winds the first screen 71 around the first winding bar 61 using driving force transmitted through the chain gear 25. At the same time, the second gear 30 unwinds/winds the second screen 72 around the second winding bar 62. The inside composition and the operation of the clutch body 10 and the clutch cover will be concretely described later.

The end body 90 supports the first winding bar 61 and the second winding bar 62 with the clutch body 10 and comprises two end shafts 91 and 92 doing a role of axis of rotation of the first winding bar 61 and the second winding bar 62.

Between the two winding bars 61 and 62 and two end shafts 91 and 92, plugs 95 and 96 and coil springs 93 and 94 are respectively interposed. The plugs 95 and 96 fix the first winding bar 61 and the second winding bar 62 to the end shafts 91 and 92 by being coupled to the first winding bar 61 and the second winding bar 62.

The coil springs 93 and 94 are inserted between the plugs 95 and 96 and the two winding bars 61 and 62 to maintain tension of the first winding bar 61 and the second winding bar 62. Those absorb shock between the winding bars 61 and 62 and the end shafts 91 and 92 and make the first winding bar 61 and the second winding bar 62 smoothly operate.

The first screen 71 and the second screen 72 are overlapped and form a roll screen 70. That is, the roll screen 70 is opened or closed by the simultaneous ascent or descent of the first screen 71 and the second screen 72 and the light shielding amount is controlled by adjusting the overlapped range of the light shielding portions 71*a* and 72*a* respectively included in the first screen 71 and the second screen 72.

The first screen 71 and the second screen 72 like the above have end portions connected to each other. For example, the first screen 71 and the second screen can be formed in one body with one screen material. That is, the first screen 71 and the second screen 72 are formed by winding both ends of one screen material around the first winding bar 61 and the second winding bar 62 and coupling a weight member 80 in the middle of the screen material in order that two sheets of screens are overlapped and form one single screen.

The first screen 71 and the second screen 72 respectively comprise the light shielding portions 71*a* and 72*a* and the light transmitting portions 71*b* and 72*b*. Here, the light shielding portions 71*a* and 72*a* are portions where light is blocked and the light transmitting portions 71*b* and 72*b* are portions where light passes through. However, the light shielding ratio and the light transmitting ratio of the light shielding portions 71*a* and 72*a* and the light transmitting portions 71*b* and 72*b* are not 100%, but these can be used as relative means. For example, the light transmitting ratio of the light shielding portions 71*a* and 72*a* can be 20% and the light transmitting ratio of the light transmitting portions 71*b* and 72*b* can be 80%. That is, the light shielding portions 71*a* and 72*a* mean portions having a relatively low light transmitting ratio. In whole area of the first screen 71 and the second screen 72, portions having a high light transmitting ratio can be called light transmitting portions 71*b* and 72*b* and portions having a low light transmitting ratio can be called light shielding portions 71*a* and 72*a*.

Meanwhile, the light shielding portions 71*a* and 72*a* and the light transmitting portions 71*b* and 72*b* can be formed in form of stripes. For example, as shown in FIG. 1, stripes parallel to the first winding bar 61 and the second winding bar 62 can be formed. The light shielding portions 71*a* and 72*a* and the light transmitting portions 71*b* and 72*b* parallel to the first winding bar 61 and the second winding bar 62 like the above can alternately be disposed.

In addition, the widths of the light shielding portions 71*a* and 72*a* and the light transmitting portions 71*b* and 72*b* can be same or the widths of the light shielding portions 71*a* and 72*a* can be larger than those of the light transmitting portions 71*b* and 72*b*. That is, it is preferable that the widths of the light shielding portions 71*a* and 72*a* are at least same with or larger than those of the light transmitting portions 71*b* and 72*b* to make the whole area of the role screen 70 possible to block light by alternately disposing the light shielding portions 71*a* of the first screen 71 and the light shielding portions 72*a* of the second screen 72.

In addition, the widths of at least ones of the light transmitting portions 71*b* and 72*b* and the light shielding portions 71*a* and 72*a* can be smaller than the circumference length of the first winding bar 61. To describe the above concretely, the relative quantity of motion of the first screen 71 and the second screen 72 cannot exceed the circumference length of the first winding bar 61. That is, when supposing that the gear ratios of the first gear 20 and the second gear 30 are same, the distance that the first screen 71 can move when the second screen 72 is stopped cannot exceed the circumference length of the first winding bar 61.

Because of the power transfer structure of the second gear 30 and the clutch hub 35, there is a certain section where the rotational force of the second gear 30 is not transferred to the clutch hub 35. In this section, the second gear 30 cannot rotate more than 360° without making contact with the clutch hub 35. That is, the second gear 30 transfers power to the clutch hub 35 before the first gear 20 having the same gear ratio as that of the second gear 30 rotates 360°.

Accordingly, the widths of the light transmitting portions 71*b* and 72*b* should be smaller than the circumference length of the first winding bar 61 in order that the light shielding portions 71*a* of the first screen 71 completely block the light transmitting portions 72*b* of the second screen 72. Here, the circumference of the first winding bar 61 means the outer circumference on which the first screen 71 is wound and the quantity of motion of the first screen 71 when the second screen 72 is stopped is decided in response to the outer circumference length of the first winding bar 61.

The pattern of the light shielding portions 71*a* and 72*a* and the light transmitting portions 71*b* and 72*b* is not limited to a form of horizontally arranged stripes, but the same can be changed into various forms. For example, a pattern of diagonally arranged stripes, a pattern of dots, etc. can be applied.

Meanwhile, since the first gear 20 and the second gear 30 engage with each other, their rotational directions are opposite to each other. Accordingly, in order that the first screen 71 and the second screen 72 simultaneously ascend or descend by the operations of the first gear 20 and the second gear 30, the directions of the first screen 71 and the second screen 72 wound around the first winding bar 61 and the second winding bar 62 are opposite to each other. For example, the first screen 71 can be wound around the first winding bar 61 in order that the first screen 71 ascends when the first winding bar 61 rotates clockwise, and the second screen 72 can be wound around the second winding bar 62 in order that the second screen 72 ascends when the second winding bar 62 rotates counterclockwise. When the first screen 71 and the second screen 72 are wound around the first winding bar 61 and the second winding bar 62 in such a way, the first screen 71 and the second screen 72 can simultaneously ascend or descend with minimizing the space between the first screen 71 and the second screen 72.

Only, the way of winding the first screen 71 and the second screen 72 is not limited to one that the first screen 71 and the second screen 72 are wound in directions opposite to each other. For example, in case that a intermediate gear (not shown) is interposed between the first gear 20 and the second gear 30, the first gear 20 and the second gear 30 can rotate in the same direction. Accordingly, the directions for winding the first screen 71 and the second screen 72 around the first winding bar 61 and the second winding bar 62 are same.

Hereinafter, the structure of the clutch module will be described in detail referring to FIGS. 2 to 5.

Figure 4:
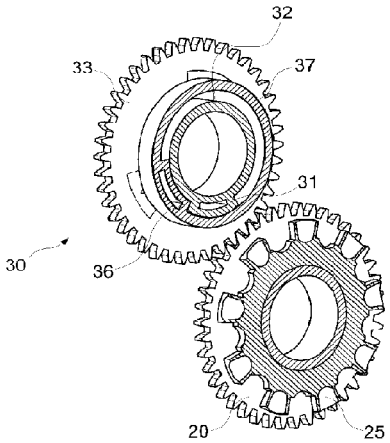
FIG. 4 is a cross-sectional perspective view formed by sectioning the clutch module in FIG. 3 along an A-A' line.
Figure 5:
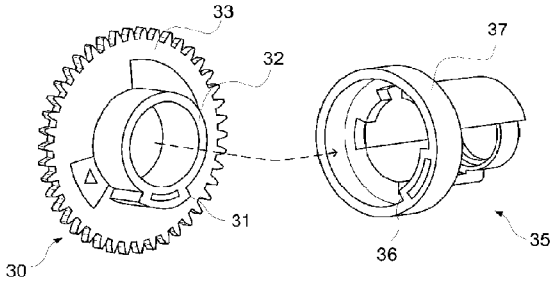
FIG. 5 is an exploded perspective view of the second gear and the clutch hub in FIG. 3.

FIG. 3 is a partial exploded perspective view of the clutch module included in the dual roll blind in FIG. 1, FIG. 4 is a cross-sectional perspective view formed by sectioning the clutch module in FIG. 3 along an A-A' line, and FIG. 5 is an exploded perspective view of the second gear and the clutch hub in FIG. 3.

First, referring to FIGS. 2 and 3, the clutch module 2 is a device for transferring driving force to the first winding bar 61 and the second winding bar 62 and the movements of the first winding bar 61 and the second winding bar 62 are selectively controlled by the operation of the ball-chain (refer to 28 in FIG. 1).

The clutch module 2 comprises the first gear 20, the second gear 30, the chain gear 25, and the clutch hub 35 received inside the clutch body 10 and the clutch cover 40, and the engagement maintaining portion 51 and 52, springs 26 and 38, and plugs 27 and 39.

The clutch body 10 comprises a first axis of rotation 11 to which the first gear 20 is coupled and a second axis of rotation 12 to which the second gear 30 is coupled. The first axis of rotation 11 and the second axis of rotation 12 are disposed in places spaced as far as the first gear 20 and the second gear 30 can engage with each other considering the sizes of the first gear 20 and the second gear 30.

The first axis of rotation 11 and the second axis of rotation 12 can diagonally be disposed. Since the first axis of rotation 11 and the second axis of rotation 12 are axis of rotation of the first winding bar 61 and the second winding bar 62, the placement of the first axis of rotation 11 and the second axis of rotation 12 affects the space between the first screen 71 and the second screen 72 respectively wound around the first winding bar 61 and the second winding bar 62. For example, in case that the first axis of rotation 11 and the second axis of rotation 12 are disposed in a horizontal direction, the initial space between the first screen 71 and the second screen 72 can be larger. However, in case that the first axis of rotation 11 and the second axis of rotation 12 are disposed in a diagonal direction, the space between the first screen 71 and the second screen 72 can be minimized and the size of the clutch module 2 can be decreased to be compact.

To the first axis of rotation 11, the first gear 20 and the chain gear 25 are coupled sequentially. The first gear 20 and the chain gear 25 always engage with each other and the chain gear 25 transfers driving force generated by the ball-chain to the first gear 20. To the chain gear 25, the spring 26 and the plug 27 are sequentially coupled and driving force of the chain gear 25 is transferred to the first winding bar 61.

To the second axis of rotation 12, the second gear 30 and the clutch hub 35 are sequentially coupled and to the clutch hub 35, the spring 38 and the plug 39 are sequentially coupled. The second gear 30 and the clutch hub 35 show a section where driving force is transferred and a section where driving force is not transferred in response to the operation of the chain gear 25.

Referring to FIGS. 4 and 5, a process of transferring driving force from the chain gear 25 to the clutch hub 35 will be described.

The chain gear 25 always engages with the first gear 20, and driving force transferred to the chain gear 25 is always transferred to the first gear 20 and the first gear 20 transfers driving force to the second gear 30. At this moment, the second gear 30 selectively transfers driving force to the clutch hub 35. Here, 'selectively' means that driving force is transferred or not in response to the rotational direction of the second gear 30, and since the rotational direction of the second gear 30 is changed in response to the operation of the ball-chain (refer to 28 in FIG. 1) connected to the chain gear 25, this means that the transference of driving force is decided in response to the user's selection.

The second gear 30 comprises a gear protrusion 31 protruding in a perpendicular direction to the direction of the axis of rotation and the clutch hub 35 comprises a clutch protrusion 36 protruding in a perpendicular direction to the direction of the axis of rotation. When the second gear 30 and the clutch hub 35 are engaged to each other, the gear protrusion 31 protrudes toward the clutch hub 35 and the clutch protrusion 36 protrudes toward the second gear 30.

If supposing an imaginary plane in a perpendicular direction to the direction of the axis of rotation, the gear protrusion 31 and the clutch protrusion 36 are formed on a same plane. The gear protrusion 31 and the clutch protrusion 36 have sides in contact to each other and through these sides, driving force is transferred, and the lengths of sections where driving force is transferred or not are decided in response to the sizes of the gear protrusion 31 and the clutch protrusion 36.

The second gear 30 comprises an axis coupling portion 32 by which the second gear 30 is coupled to the second axis of rotation 12 and a teeth portion 33 where teeth of the gear are formed. The teeth portion 33 is a portion by which the second gear 30 engages with the first gear 20 and the same is connected with the axis coupling portion 32 to rotate on the second axis of rotation 12.

The gear protrusion 31 is formed on a side of the axis coupling portion 32 by protruding. The axis coupling portion 32 and the gear protrusion 31 are inserted into and fixed to a hub ring 37 of the clutch hub 35, and the hub ring 37 is one end portion of the clutch hub 35 and this is where the axis coupling portion 32 of the second gear 30 is inserted. Inside the hub ring 37, the clutch protrusion 36 protrudes toward inside.

There is a space as large as the gear protrusion 31 and the clutch protrusion 36 can rotate between the axis coupling portion 32 and the hub ring 37. Here, the gear protrusion 31 and the clutch protrusion 36 are positioned between the axis coupling 32 and the hub ring 37 and the gear protrusion 31 protrudes toward the clutch hub 35 and the clutch protrusion 36 protrudes toward the second gear 30.

In the space between the axis coupling portion 32 and the hub ring 37, only the gear protrusion 31 and the clutch protrusion 36 are positioned and as the axis coupling portion 32 rotates inside the hub ring 37, the side portion of the gear protrusion 31 comes into contact with or is parted from the side portion of the clutch protrusion 36. That is, the section where the gear protrusion 31 is in contact with the clutch protrusion 36 is a section where driving force is transferred and the section where the gear protrusion 31 is parted from the clutch protrusion 36 is a section where driving force is not transferred.

In the above description, a type that the axis coupling portion 32, an end portion of the second gear 30 is inserted inside the clutch hub 35 is used as an example, however, this is not limitative, and variations are possible. For example, a type that an end portion of the clutch hub is inserted into the second gear.

In addition, a case that the gear protrusion 31 and the clutch protrusion 36 protrude in a perpendicular direction to the axis of rotation is described as an example, however, this is not limitative, and the gear protrusion and the clutch protrusion can protrude in the same direction as the second axis of rotation. In other words, it can be a structure that the second gear and the clutch hub are disposed in the same direction as the second axis of rotation, and the gear protrusion protrudes toward the clutch hub and the clutch protrusion protrudes toward the second gear to transfer driving force through the side portions of the gear protrusion and the clutch protrusion coming into contact with each other.

Hereinafter, an opening and closing process and a light transmittance controlling process of the dual roll blind will be described in detail referring to FIGS. 6*a* to 6*e*.

FIGS. 6*a* to 6*e* are side views and partially enlarged views for explaining the operating process of the dual roll blind in FIG. 1.

Figure 6A:
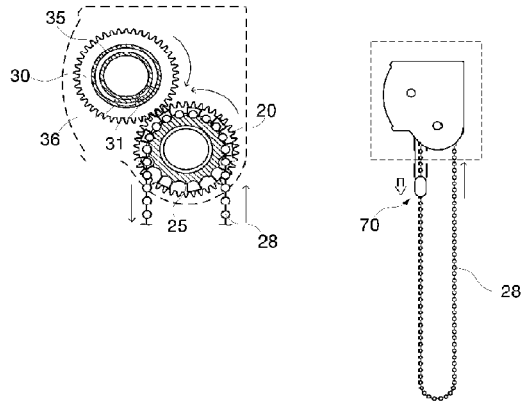
FIGS. 6*a* to 6*e* are side views and partially enlarged views for explaining the operating process of the dual roll blind in FIG. 1.

First, referring to FIG. 6*a*, the roll screen 70 descends by operation of the ball-chain 28. To describe the above concretely, the ball-chain 28 is pulled in order that the chain gear 25 rotates counterclockwise. At this moment, the first gear 20 rotates counterclockwise and the second gear 30 rotates clockwise.

When the second gear 30 rotates clockwise, the gear protrusion 31 comes into contact with the clutch protrusion 36 of the clutch hub 35. When the gear protrusion 31 comes into contact with the clutch protrusion 36, rotational force of the second gear 30 is transferred to the second winding bar 62 through the clutch hub 35.

When the gear protrusion 31 and the clutch protrusion 36 come into contact with each other as the above, the first gear 20 and the second gear 30 respectively rotate in opposite directions and the roll screen 70 descends.

While the roll screen 70 descends, the light transmitting portions 71*b* of the first screen 71 and the light transmitting portion 72*b* of the second screen 72 are overlapped each other. That is, the roll screen 70 descends in a state of high light transmittance.

Figure 6B:
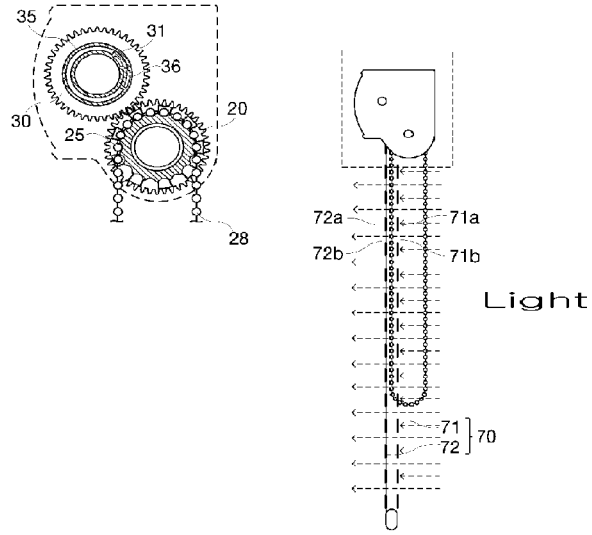

Next, FIG. 6*b* shows a state that the roll screen 70 has completely descended by operation of the ball-chain 28. To describe the above concretely, when the chain gear 25 rotates counterclockwise, the gear protrusion 31 transfers rotational force to the clutch protrusion 36 and the roll screen 70 is completely down.

Here, the light shielding portions 71*a* of the first screen 71 and the light shielding portions 71*a* of the second screen 72 maintain to be overlapped each other. Accordingly, light passes through the light transmitting portions 72*b* of the second screen 72 and the light transmitting portions 71*b* of the first screen 71 one by one.

In a state that the roll screen 70 is completely down, a clockwise side portion of the gear protrusion 31 is in contact with the clutch protrusion 36.

Next, FIG. 6 *c* shows a process of controlling the light transmission amount of the roll screen 70. To describe the above concretely, the ball-chain 28 is pulled in order that the chain gear 25 rotates clockwise.

When the chain gear 25 rotates clockwise in a state that the roll screen 70 is down, the first gear 20 rotates clockwise and the second gear 30 rotates counterclockwise.

At this moment, although the second gear 30 rotates counterclockwise, the clutch hub does not rotate along for a certain period of time. When the clutch hub 35 does not rotate, the second screen 72 is not wound up around the second winding bar 62. Such a section is a non-contact section where driving force is not transferred between the gear protrusion 31 and the clutch protrusion 36.

Figure 6C:
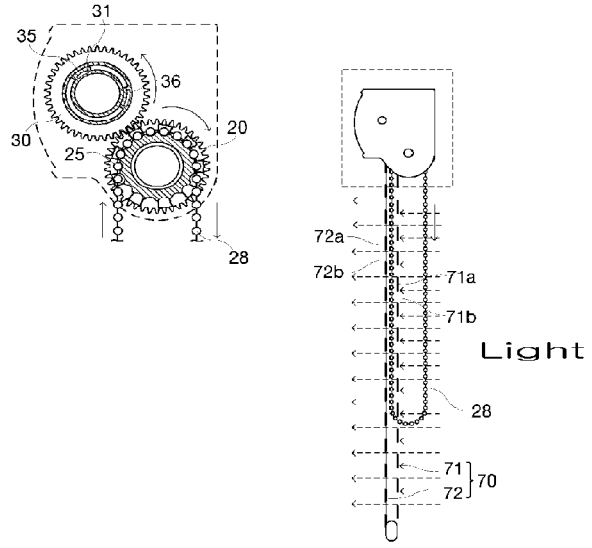

If comparing FIGS. 6*b* and 6*c*, when the chain gear 25 rotates clockwise, the clutch hub 35 is stopped as shown in FIG. 6*b*. That is, although the clutch hub 35 is stopped, the gear protrusion 31 of the second gear 30 rotates counterclockwise.

When the first screen 71 ascends in a state that the second screen 72 is stopped as the above, the light transmitting portions 72*b* of the second screen 72 and the light shielding portions 71*a* of the first screen 71 are overlapped each other and the light transmission amount is reduced. That is, the non-contact section where driving force is not transferred between the gear protrusion 31 and the clutch protrusion 36 is a section where the light transmission amount of the roll screen 70 is changed.

Figure 6D:
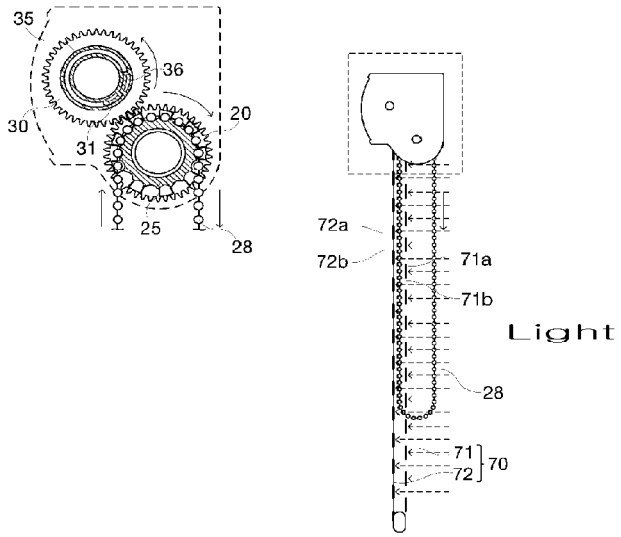

Next, FIG. 6*d* shows a state that the light shielding portions 71*a* of the first screen 71 and the light transmitting portions 72*b* of the second screen 72 are completely overlapped each other.

If comparing FIGS. 6*b* to 6*d* one by one, when the gear protrusion 31 of the first gear 20 rotates counterclockwise, the clutch protrusion 36 of the clutch hub 35 is stopped. That is, the second screen 72 driven by the clutch hub 35 is stopped and the first screen 71 driven by the first gear 20 ascends.

To describe the above concretely, the gear protrusion 31 is in contact with a counterclockwise side of the clutch protrusion 36 in FIG. 6*b*, however, the gear protrusion 31 comes into contact with a clockwise side of the clutch protrusion 36 through the operations shown in FIGS. 6*c* and 6*d*. Accordingly, the gear protrusion 31 rotates counterclockwise when the clutch protrusion 36 is stopped and cannot transfer rotational force to the clutch protrusion 36 until the same comes into contact again with the clutch protrusion 36.

Figure 6E:
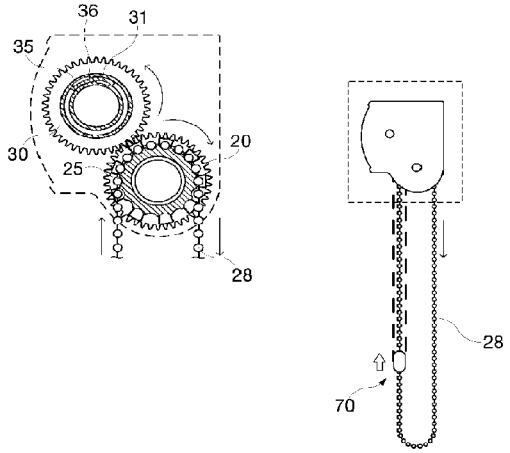

Next, FIG. 6*e* shows a process that the roll screen 70 ascends.

When the ball-chain 28 is pulled in order that the chain gear 25 continuously rotates clockwise after the state of FIG. 6*d*, the roll screen 70 ascends. Concretely, the gear protrusion 31 continuously rotates counterclockwise in the state of FIG. 6*d* to rotate counterclockwise the clutch protrusion 36 too.

Accordingly, the first gear 20 rotates clockwise and the second gear 30 rotates counterclockwise, and therefore the first screen 71 and the second screen 72 ascend simultaneously. At this moment, the screen ascends in a state that the light shielding portions 71*a* of the first screen 71 and the light transmitting portions 72*b* of the second screen 72 are overlapped each other. However, the state that the light shielding portions 71*a* and 72*a* and the light transmitting portions 71*b* and 72*b* are overlapped each other when the roll screen 70 ascends or descends as the above is just an example and the overlapped state can be changed as need demands.

Hereinafter, the engagement maintaining portion for maintaining the engagement of the first gear and the second gear will be described in detail referring to FIGS. 7*a* and 7*b*.

Figure 7A:
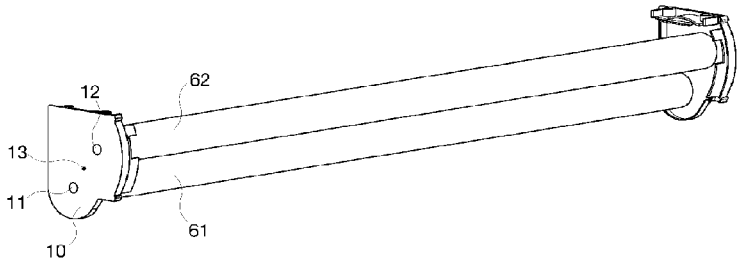
FIG. 7*a* is a perspective view of the dual roll screen from other direction.
Figure 7B:
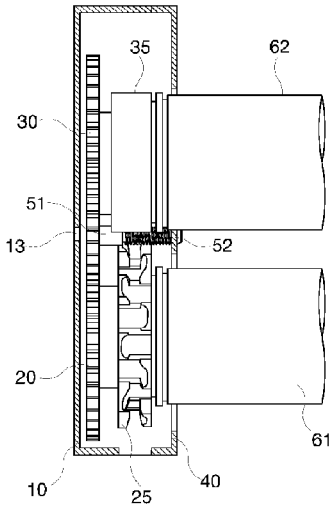
FIG. 7*b* is a view showing the inside of the clutch body and the clutch cover in FIG. 7.

FIG. 7*a* is a perspective view of the dual roll screen from other direction and FIG. 7*b* is a view showing the inside of the clutch body and the clutch cover in FIG. 7.

Inside the clutch body 10 and the clutch cover 40, the engagement maintaining portion 51 and 52 for providing elasticity to maintain the engagement of the first gear 20 and the second gear 30 are mounted.

The engagement maintaining portion 51 and 52 are means for providing elasticity in the same direction as the axis of rotation to one of the first gear 20 or the second gear 30 to prevent the gear from breaking away. This will be described as a means for providing elasticity to the second gear 30 in this embodiment, however, this can be changed a means for providing elasticity to the first gear 20 if necessary.

The engagement maintaining portion 51 and 52 comprises a gear supporting member 51 and an elastic member 52. Such an engagement maintaining portion 51 and 52 is a means for assisting the stable engagement of the first gear 20 and the second gear 30 and this provides elasticity in order that the second gear 30 breaks away from the first gear 20 when external force is transferred in the same direction as the second axis of rotation 12 and the second gear 30 engages again with the first gear 20 when the external force is removed.

The clutch body 10 comprises a setting hole 13 corresponding to the engagement maintaining portion 51 and 52 with the first gear 20 and the second gear 30 as a center. The setting hole 13 is a hole through which external force is applied from outside of the clutch body 10 to the second gear 30. Pressure can be applied through the setting hole 13 using a tool.

It is preferable to dispose the setting hole 13 to be symmetrical with the engagement maintaining portion 51 and 52 with the second gear 30 as a center. In this way, when pressure is applied to the second gear 30 through the setting hole 13, the second gear 30 breaks away from the first gear 20 and the elastic member 52 of the engagement maintaining portion 51 and 52 constricts.

Here, when the pressure applied to the second gear 30 is removed, the second gear 30 engages again with the first gear 20 by elasticity of the elastic member 52.

The elastic member 52 applies elasticity to the gear supporting member 51 in contact with the second gear 30 in order that the gear supporting member 51 prevents breakaway of the second gear 30. The gear supporting member 51 and the elastic member as the above can be fixed to the clutch cover 40, however, it is not limitative but can be changed in various ways.

In addition, the elastic member 52 means an elastic stuff possible to constrict as small as the second gear 30 can break away when external force is applied and to be restored in order that the second gear 30 can engage again with the first gear 20 when the external force is removed. For example, various elastic stuffs such as rubber, coil spring, flat spring, etc.

In this embodiment of the present invention, a structure that the second gear 30 breaks away in the same direction as the axis of rotation will be described, however, it is not limitative, and a structure that the second gear 30 breaks away in a vertical direction to the axis of rotation can be possible.

Hereinafter, a breakaway of the second gear and an operation process of the engagement maintaining portion will be described in detail referring to FIGS. 8*a* and 8*b*.

Figure 8A:
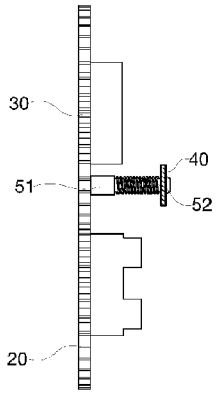
FIGS. 8*a* and 8*b* are views for showing the operating process of the first gear, the second gear, and the engagement maintaining portion.
Figure 8B:
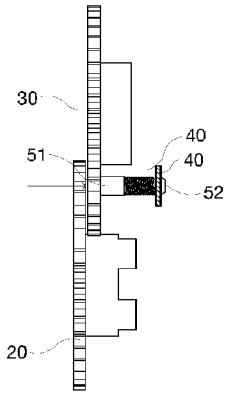

FIGS. 8*a* and 8*b* are views for showing the operating process of the first gear, the second gear, and the engagement maintaining portion. First, referring to FIG. 8*a*, the first gear 20 and the second gear 30 disposed side by side engage with each other. Here, the gear supporting member 51 provides elasticity in the same direction as the second axis of rotation 12 from a side of the second gear 30.

The second gear 30 and the clutch body 10 are fixed to the second axis of rotation 12 and the second gear 30 does not break away to the opposite side of the engagement maintaining portion 51 and 52 although this is not shown in FIG. 8*a*. Accordingly, while the gear supporting member 51 provides elasticity to the second gear 30, the second gear 30 engages with the first gear and operates.

Next, referring to FIG. 8*b*, when external force is applied to the second gear 30 in the same direction as the second axis of rotation 12, the second gear 30 breaks away from the first gear 20. At this moment, the second gear 30 breaks away along with the second axis of rotation 12 and the elastic member 52 of the engagement maintaining portion 51 and 52 constricts.

In case that the second gear 30 breaks away from the first gear 20 as the above, the first gear 20 and the second gear 30 can separately rotate.

FIG. 8*b* shows a structure that the whole second gear 30 horizontally moves, however, the whole second gear 30 does not necessarily have to horizontally move, but can slightly move enough that the second gear 30 can break away from the first gear 20.

Hereinafter, a setting process for arranging patterns of the light shielding portions and the light transmitting portions of the first screen and the second screen will be described in detail referring to FIGS. 9*a* and 9*b*.

Figure 9A:
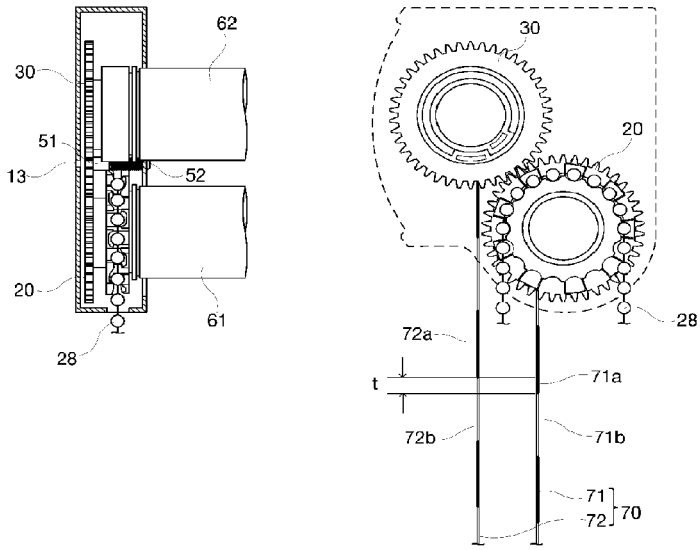
FIGS. 9*a* and 9*b* are views for explaining the setting process of the light shielding portions and the light transmitting portions of the first screen and the second screen.
Figure 9B:
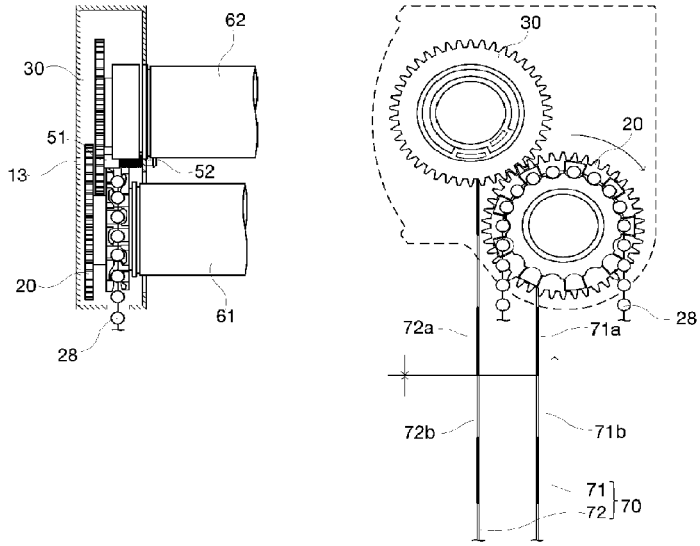

FIGS. 9*a* and 9*b* are views for explaining the setting process of the light shielding portions and the light transmitting portions of the first screen and the second screen.

First, referring FIG. 9*a*, the light shielding portions 71*a* of the first screen 71 and the light shielding portions 72*a* of the second screen 72 are not completely overlapped each other at the initial setting point. It is not easy to completely arrange patterns of the light shielding portions 72*a* and the light transmitting portions 71*b* and 72*b* of the first screen 71 and the second screen 72 in production of dual roll blind 1.

In addition, in case that the dual roll blind is used for a long time and the engagement position of the first gear 20 and the second gear 30 is changed by external force while being used, the patterns of the first screen 71 and the second screen 72 does not correspond with each other.

Accordingly, the arrangement of patterns of the first screen 71 and the second screen 72 should be carried out after having mounted the first screen 71 and the second screen 72 respectively on the first winding bar 61 and the second winding bar 62.

There is a space as much as t between the light shielding portion 71*a* of the screen 71 and the light shielding portion 72*a* of the second screen 72.

Next, referring to FIG. 9*b*, the second gear 30 breaks away from the first gear 20 when external force is applied to the second gear 30 through the setting hole 13.

At this moment, although the first gear 20 rotates, the second gear 30 does not rotate by interconnection. Accordingly, it is possible to adjust the light shielding portions 71*a* of the first screen 71 and the light shielding portions 72*a* of the second screen 72 to be completely overlapped each other by rotating the first gear 20 using the ball-chain 28 with keeping external force applied to the second gear 30.

INDUSTRIAL APPLICABILITY

Although the embodiments of the present invention are described referring to attached drawings in the above, persons of ordinary skill in the art where the present invention belongs will be able to understand that the present invention can be realized in other concrete forms without changing the technical ideas or essential features. Therefore, all the above-described embodiments should be understood as examples and not limitative in every aspect.

The invention claimed is:

1. A dual roll blind comprising:

a first screen and a second screen having light transmission portions and light shielding portions, respectively;

a first winding bar and a second winding bar for respectively winding the first screen and the second screen;

a first gear for rotationally driving the first winding bar and inserted into a first axis of rotation;

a second gear for rotating the second winding bar, rotating dependently on the first gear and inserted into a second axis of rotation;

an engagement maintaining portion comprising a gear supporting member and an elastic member for providing elasticity in a parallel direction with respect to one of the first gear axis and the second gear axis;

a clutch body and a clutch cover, wherein the first gear, the second gear, and the engagement maintaining portion are located in a space defined by the clutch body and the clutch cover; and a clutch hub interposed between the second gear and the second winding bar for transmitting rotational force of the second gear to the second winding bar, wherein the clutch body comprises a setting hole positioned correspondingly to a position of the engagement maintaining portion, and at least one of the first gear and the second gear is disposed between the setting hole and the engagement maintaining portion, wherein the gear supporting member is in contact with at least one of the first gear and the second gear, and the elastic member applies elasticity to the gear supporting member, wherein the gear supporting member and the elastic member are fixed to the clutch cover, wherein the second gear comprises: a circular coupling portion extended from a front surface of the second gear and having a hole configured to receive the second axis of rotation; and a gear protrusion protruding toward the clutch hub and located on an outer circumferential surface of the coupling portion, wherein the clutch hub comprises: a hub ring configured to be inserted into the circular coupling portion; a cylindrically shaped portion extending from the hub ring and configured to receive the second winding bar, the diameter of the cylindrically shaped portion being smaller than that of the hub ring; and a clutch protrusion protruding toward the second gear such that the clutch protrusion makes contact with a portion of the gear protrusion for transmitting rotational force of the second gear to the clutch hub, wherein the gear protrusion and the clutch protrusion do not come in contact with each other depending on the rotational position of the second gear where rotational force of the second gear is not transmitted to the clutch hub, and wherein both of the gear protrusion and the clutch protrusion protrude in a perpendicular direction to the axes of the second gear and the clutch hub.

2. The dual roll blind according to the claim 1, wherein the first gear and the second gear have the same gear ratios and directly engage with each other.

3. The dual roll blind according to the claim 1, further comprising a chain gear driven by a ball-chain and coupled to the first gear, wherein the second gear is deviated from the first gear when an external force is transferred in the parallel direction with respect to the axis of the second gear.

4. The dual roll blind according to the claim 1, wherein the clutch protrusion protrudes from the circumference of the second gear to the center.

5. The dual roll blind according to the claim 1, wherein each one end of the first screen and the second screen is wound around the first winding bar and the second winding bar respectively, and the other ends of the first screen and the second screen are directly connected to one another.

6. The dual roll blind according to the claim 5, further comprising a weight member inserted between the first screen and the second screen to apply a load therebetween.

7. The dual roll blind according to the claim 1, wherein light transmitting portions and light shielding portions are formed in a form of stripes parallel to the first winding bar and the second winding bar and alternately disposed on the first screen and the second screen, and the widths of at least ones of the light transmitting portions and the light shielding portions are smaller than the circumference length of the first winding bar.

8. The dual roll blind according to the claim 7, wherein the widths of the light shielding portions are larger than those of the light transmitting portions.

* * * * *